United States Patent [19]

Sillars

[11] Patent Number: 4,893,559

[45] Date of Patent: Jan. 16, 1990

[54] METHOD AND APPARATUS FOR PRINTING QUASI RANDOM NUMBER TABLES IN A FLEXOGRAPHIC PRESS

[76] Inventor: Ian M. Sillars, 2704 The Strand, Manhattan Beach, Calif. 90266

[21] Appl. No.: 133,666

[22] Filed: Dec. 16, 1987

[51] Int. Cl.[4] ..... B41F 5/18; B41F 5/24

[52] U.S. Cl. ..... 101/216; 101/40.1; 101/178

[58] Field of Search ..... 101/DIG. 27, 216, 217, 101/218, 219, 232, DIG. 22, 181, 180, 142, 38 A, 76, 72, 40.1, 178

[56] References Cited

U.S. PATENT DOCUMENTS

| | | | |
|---|---|---|---|
| 2,435,791 | 2/1948 | Luehrs | 101/180 |
| 2,788,738 | 4/1957 | Wood | 101/180 X |
| 3,405,633 | 10/1968 | Price, Jr. et al. | 101/38 A X |
| 4,538,516 | 9/1985 | Aaron | 101/DIG. 27 |
| 4,584,939 | 4/1986 | Giori | 101/DIG. 22 |
| 4,601,239 | 7/1986 | Sillars | 101/142 X |

FOREIGN PATENT DOCUMENTS

| | | | |
|---|---|---|---|
| 1577451 | 8/1969 | France | 101/DIG. 27 |

*Primary Examiner*—Clifford D. Crowder
*Attorney, Agent, or Firm*—Hecker & Harriman

[57] ABSTRACT

Method and apparatus for printing quasi random number tables comprising a printing press having one or more printing stations incorporating a plurality of endless belts, each entrained around a printing plate cylinder and an idle roller, each belt being a different length which is a multiple of a basic pitch value, and each belt having affixed to the outer surface thereof and arranged in a row along the length of the belt, a plurality of printing plates arranged to print an impression onto a web or other medium passing through the press in register with a similar impression printed by each other belt. In one form of the invention each plate prints a number such that each belt prints different numbers in register, forming larger numbers or tables whose digits change from impression to impression in a quasi random manner. In one form of the invention each printing station incorporates one said belt. In an alternative form of the invention at least one printing station incorporates a plurality of belts entrained about a common printing plate cylinder. Each belt may be inked from a common source or may be independently inked so that a number of different colors may be printed at the one station. Preferably, each belt is provided with a tension roller or shoe arranged to tension the belt about the printing plate and idle rollers. This is particularly important when a plurality of belts of different lengths are entrained about common printing plate and idle rollers at the same station.

6 Claims, 7 Drawing Sheets

METHOD AND APPARATUS FOR PRINTING QUASI RANDOM NUMBER TABLES IN A FLEXOGRAPHIC PRESS

BACKGROUND OF THE INVENTION

1. Field of the Invention

This invention relates to apparatus for printing quasi random number tables and has been devised particularly though not solely for printing tables for games of chance.

2. Background Art

This invention is a development of the printing apparatus described in my granted U.S. Pat. Nos. 4,451,333 and 4,601,239. In those specifications there is described a flexographic printing press which can be set up to print quasi random number tables for games of chance. These tables are seldom true random number tables but incorporate a very large number of variables which are eventually repeated after a large number of tables have been printed. To the end user, however, each table appears to incorporate a matrix of apparently random numbers and is referred to throughout this specification as a "quasi random number table".

The apparatus described in my U.S. patents referred to above is very effective in a large number of situations but requires the use of an entire flexographic press which may not always be available in some printing situations. Furthermore, the size of the table printing cylinders which may be utilized in a flexographic press is limited due to the physical constraints of the press and therefore the number of different tables which can be printed before the sequence of apparently random numbers begins to repeat is also limited. The number of different tables which can be printed would be increased if larger table printing cylinders could be used, but these cannot be physically accommodated on a conventional flexographic press.

The central impression press described in my above referenced U.S. patent specifications is also limited to printing on flexible webs such as paper or sheet plastics film. It is some times desirable to print quasi random number tables for games of change onto cylindrical objects such as soft drink cans, paper cups, cardboard tubes or the like.

SUMMARY OF THE PRESENT INVENTION

The present invention therefore provides apparatus for printing quasi random number tables comprising a printing press having one or more printing stations incorporating a plurality of endless belts, each entrained around an impression roller and an idle roller, each belt being a different length which is a multiple of a basic pitch value, and each belt having affixed to the outer surface thereof and arranged in a row along the length of the belt, a plurality of printing plates arranged to print an impression onto a web or other medium passing through the press in register with a similar impression printed by each other belt.

In one form of the invention each plate prints a number such that each belt prints different numbers in register, forming larger numbers or tables whose digits change from impression to impression in a quasi random manner.

In one form of the invention each printing station incorporates one said belt.

In an alternative form of the invention at least one printing station incorporates a plurality of belts entrained about a common impression roller. Each belt may be inked from a common source or may be independently inked so that a number of different colors may be printed at the one station.

Preferably, each belt is provided with a tension roller or shoe arranged to tension the belt about the impression and idle rollers. This is particularly important when a plurality of belts of different lengths are entrained about common impression and idle rollers at the same station.

Notwithstanding any other forms that may fall within its scope, one preferred form of the invention will now be described by way of example only with reference to the accompanying drawings.

DETAILED DESCRIPTION OF THE PRESENT INVENTION

In the preferred form of the invention a printing station which may be used on many different types of presses such as central impression flexographic presses, rotogravure presses, stack presses, or narrow web presses is constructed as follows.

Figure 1:
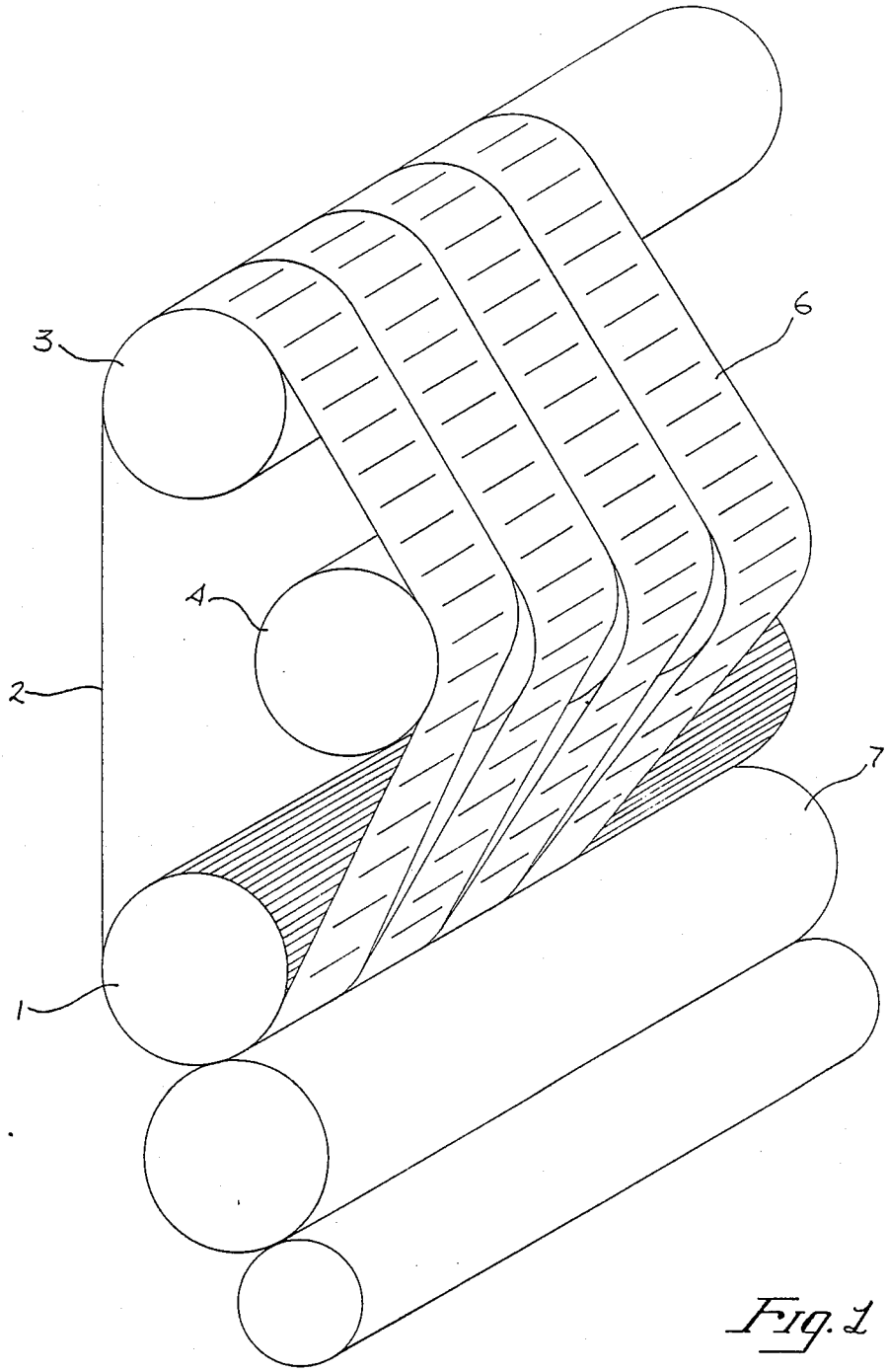
FIG. 1 is a perspective view of printing apparatus according to the invention having four belts of different lengths provided at a single printing station.

Referring to FIG. 1, the station has an impression or printing plate cylinder or roller (1) which is driven by the drive mechanism of the press in the normal manner. An endless belt (2) is entrained around the impression of printing plate cylinder and also around an idle roller (3) spaced from the impression or printing plate cylinder. In some forms of the invention a tension roller (4) may also be provided to tension the belt about the impression or printing plate and idle rollers.

The belt (2), is typically a non-elastic nylon belt having internal teeth on the inner surface of the belt which are engaged with gear teeth (5) on the impression or printing plate cylinder to keep the belt always in register with the motion of the impression or printing plate cylinder.

The outer surface of the belt is provided with a plurality of flexographic printing plates (6) which are adhered to the nylon belt at a predetermined basic pitch value or gradient. As can be seen from FIG. 3 the plates (6) are typically arranged to print numbers such as the three digit numbers shown and are spaced on the belt at a typical gradient of half an inch (12mm).

Figure 2:
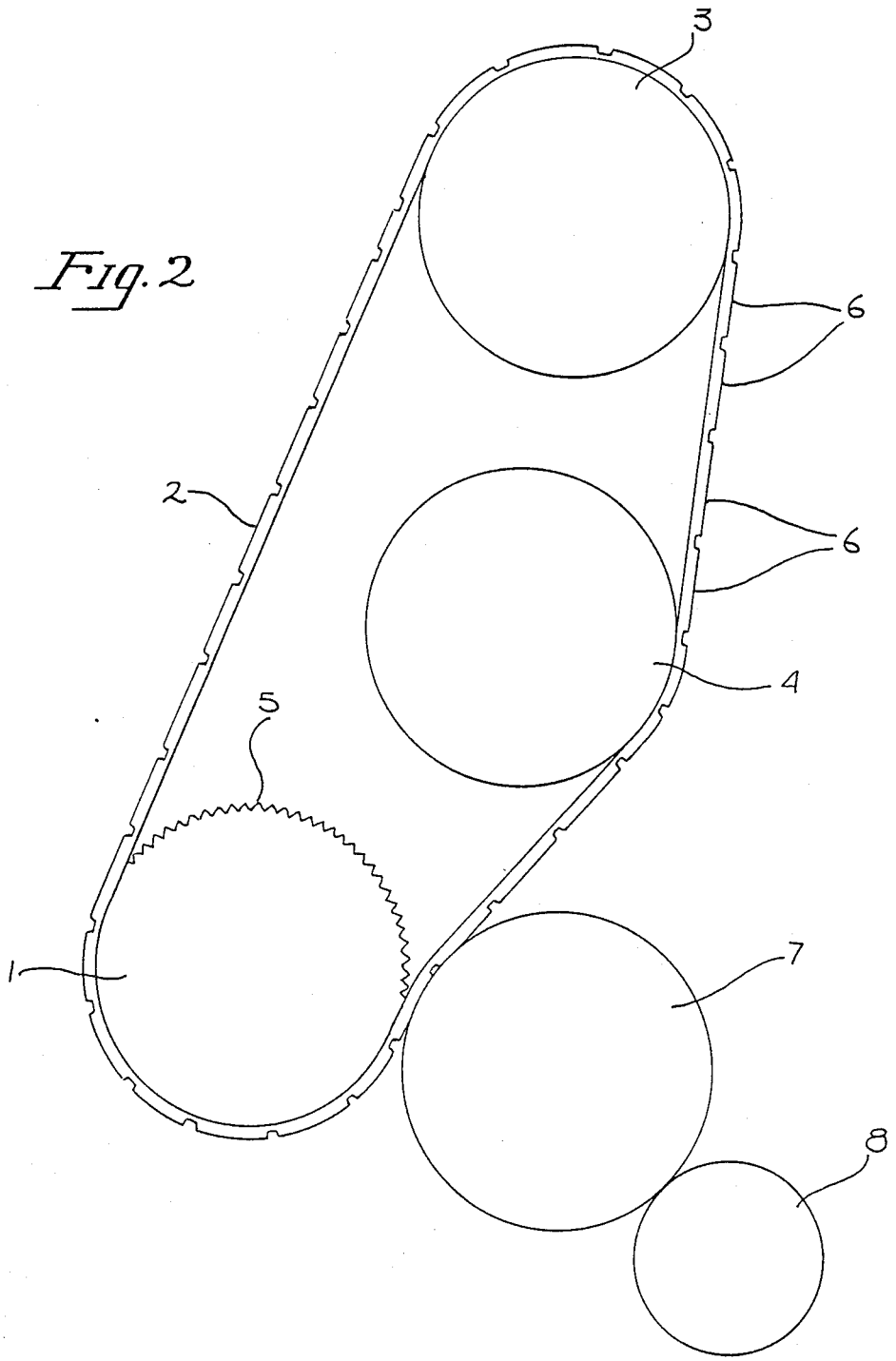
FIG. 2 is an end view of the apparatus shown in FIG. 1, showing only one belt for clarity.

Each station may incorporate a single belt of the type shown in FIG. 2, or alternatively a number of belts such as the four belts shown in FIG. 1 may be positioned side by side on common elongate impression or printing plate and idle rollers. In the latter situation each belt has its own tension roller (4) which is located in a different position from the tension rollers of the other belts so that four or six belts each of different length may be entrained about the common or printing plate and idle rollers. Although the tensioning device has been shown as a tension roller it will be appreciated that a tension shoe or other similar device may also be utilized.

The flexographic plates on the belt (2) are inked by way of an anilox roller (7) which is in turn inked from an inking roller (8) in the conventional manner.

Figure 3:
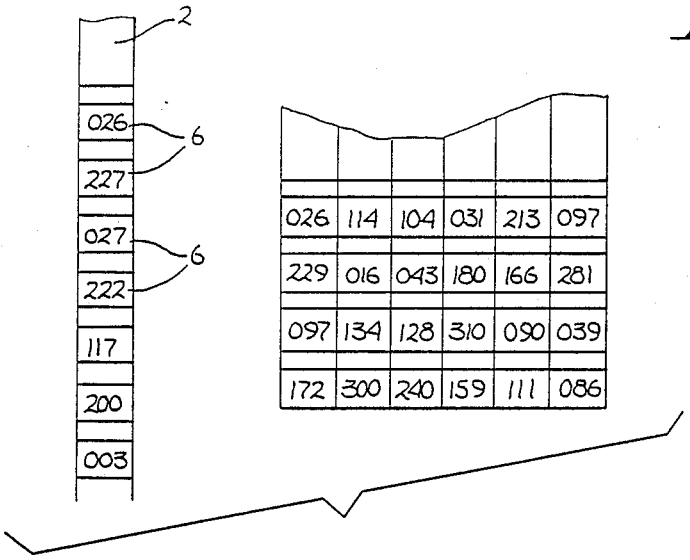
FIG. 3 shows a sample of the outer surface of a belt used in the apparatus according to the invention, and a sample of a table that may be printed by six such belts used together.

A six belt printing station of the type shown in FIG. 1 may therefore be utilized with six belts all of different length (but each a multiple of the basic pitch value or gradient) to print quasi random number tables of the type shown in FIG. 3.

Figure 4:
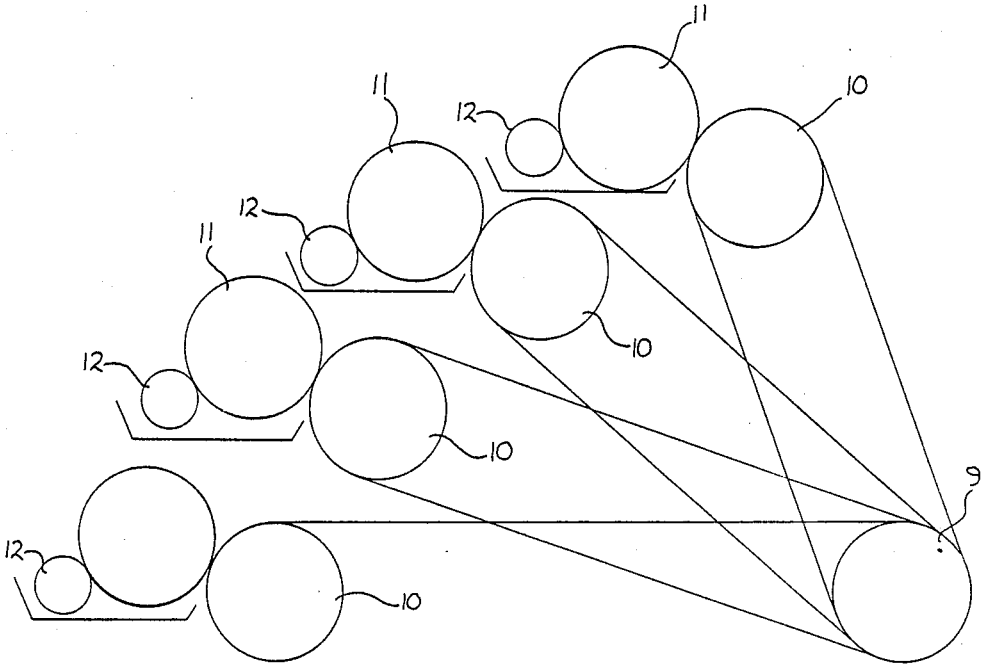
FIG. 4 is a diagrammatic end view of four belts used at a single station, wherein each belt is inked from a separate source allowing a different color to be used on each belt.

As a further variation, as shown in FIG. 4, a number of different belts, e.g. four belts may be entrained about a common elongate printing or impression cylinder (9) and then each belt entrained about an independent idle roller (10). The configuration allows each belt to be independently inked via an anilox roller (11) and an inking roller (12) provided as separate items for each belt so that each belt may be inked with a different color. This adds a further variation or variable to the quasi random number table that may be printed by the apparatus.

Figure 11:
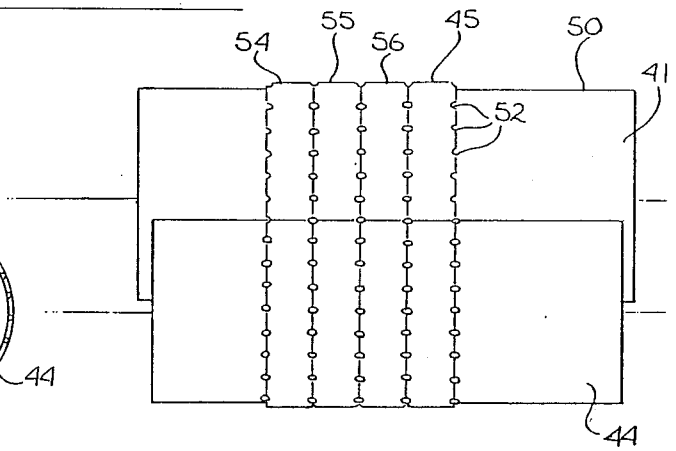
FIG. 11 is a top view of the belt of FIG. 10.
Figure 10:
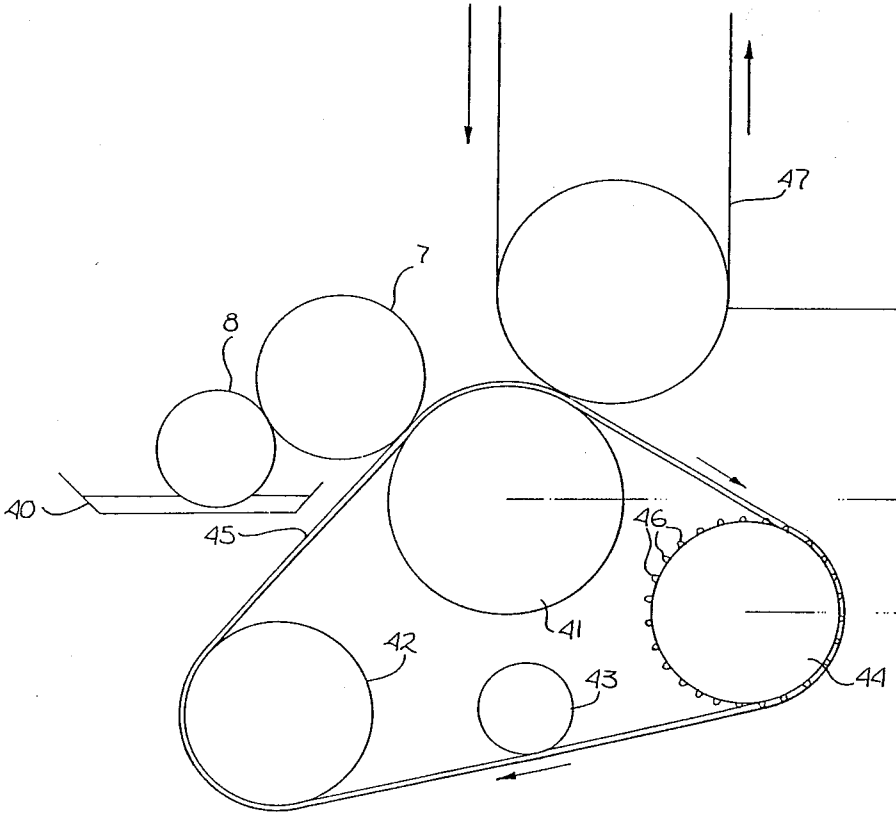
FIG. 10 is a diagrammatic end view of an alternate embodiment of the present invention as part of an endless belt system.

An alternate embodiment of the present invention is illustrated in FIG. 10. A belt 45 is entrained about a printing cylinder 41, tension cylinder 42 and drive cylinder 44. An optional tension cylinder 43 may be utilized if desired. The drive cylinder 44 includes a plurality of pins or protrusions 46 for engaging openings in belt 45. The drive cylinder 44 is turned so as to move belt 45 about the other cylinders. In the example shown, drive cylinder 44 turns in a clockwise direction, however, it may also be used in a counter clockwise direction if desired. Referring briefly to FIG. 11, a top view of belt 45 entrained about printing cylinder 41 and drive cylinder 44 is illustrated. Also shown are additional belts 54–56. Each of the belts includes a plurality of openings or indentations 52 registered with the pins 46 of drive cylinder 44. This allows the engagement of the belt 45 with the gearing of the drive cylinder 44.

Referring again to FIG. 10, an ink roller 8 receives ink from ink font 40 and transfers it to anilox roller 7. Anilox roller 7 engages the belt 45 at printing cylinder 41 and transfers the ink to the belt 45. Belt 45 engages web 47 at impression cylinder 1 and transfer the image of belt 45 to the web 47. Web 47 is entrained about impression cylinder 1. Although only a single belt 45 is shown in FIG. 10, a number of belts such as belts 54–56 of FIG. 11 may be entrained about a common tension cylinder and printing cylinder. An optional tension roller such as tension roller 43 may be used to tension belts of various pitch ratios and lengths as shown in FIG. 1.

Figure 5:
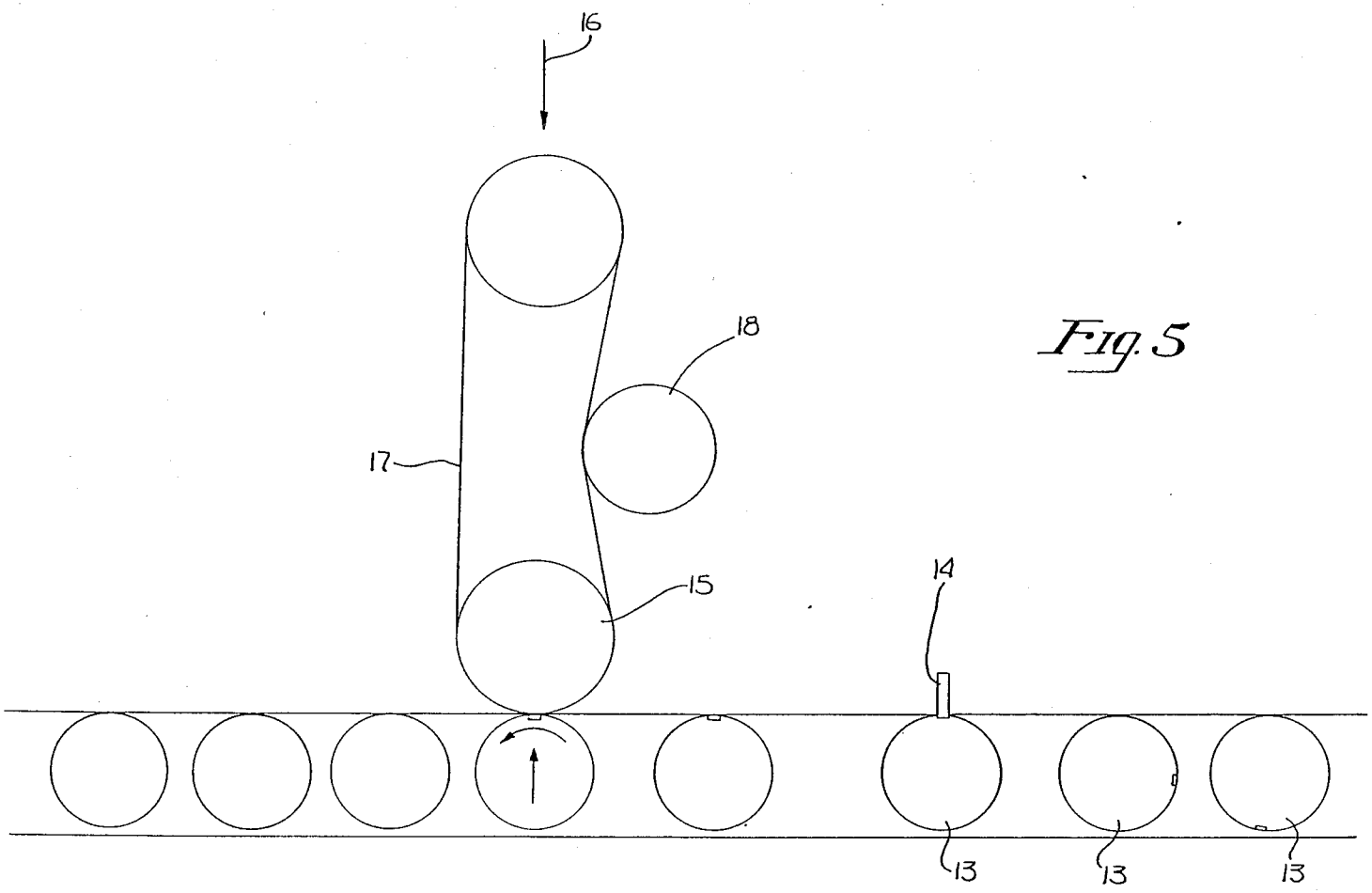
FIG. 5 is a diagrammatic end view of the apparatus according to the invention used for printing onto cylindrical objects such as cans.

The printing apparatus according to the invention has the further advantage that it can be utilized not only for printing on webs such as paper or plastics film material but it can also be used for printing onto cylindrical objects such as soft drink cans or paper cups. FIG. 5 shows an application of printing onto cans (13) which are fed through the normal can printing line and revolve as they pass down the line. A photocell (14) in the printing line activates a clutch to stop the revolving can into a predetermined alignment for printing, whereupon the can passes beneath the impression cylinder (15) of a printing station (16) according to the invention. The printing station has endless belts (17) and a tension roller (18) of the type previously described and is also provided with the inking apparatus earlier described but not shown in FIG. 5. Although FIG. 5 only shows the end view of a single belt, it would of course be normal to incorporate a number of belts entrained about the impression cylinder (15) in a similar manner to the apparatus shown in FIG. 1 or FIG. 4.

As the can passes beneath the impression roller (15) it rises up to touch the periphery of the belt and rotates in contact with the printing belt to print the impression from the flexographic plates on the belt onto the can. In this way quasi random number tables of the type shown in FIG. 3, or single lengthy quasi random numbers can be printed onto the surface of a can or any cylindrical object and used in games of chance in the same way as quasi random number of tables printed onto sheet material.

The belt printing station according to the invention may be utilized in a number of different ways on flexographic, photogravure, stack or narrow web presses as will now be described with reference to FIGS. 6 to 9.

Figure 6:
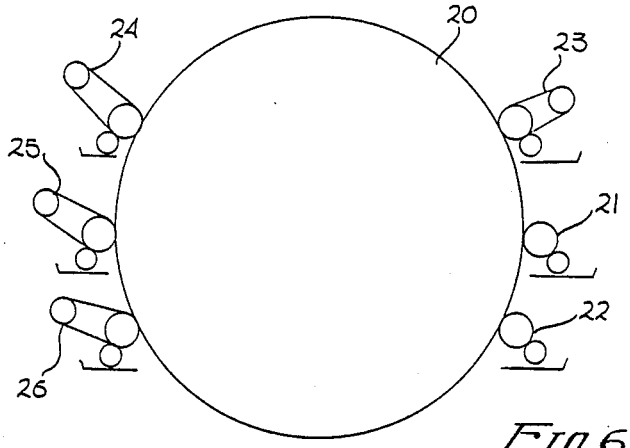
FIG. 6 is a diagrammatic end view of a flexographic central impression press incorporating four single belt printing stations according to the invention.

FIG. 6 shows a conventional central impression flexographic press having a central impression cylinder (20) and two conventional printing stations (21) and (22). In place of the remaining printing stations that would normally form part of the central impression press, single belt printing stations (23), (24), (25) and (26) are provided. These stations each have an impression roller, idle roller and optionally a tension roller about which a single belt is entrained. In many regards, this form of the invention is similar to that described in my granted U.S. Pat. Nos. 4,541,333 and 4,601,239 except that by the use of belts as stations (23), (24), (25) and (26) it is possible to utilize a greater number of gradients at these stations than would be possible using conventional printing cylinders. In the example shown in FIG. 6 stations of 41, 61, 59, and 53 gradients are utilized which would be difficult if not impossible if using conventional cylinders due to the large size of the cylinders required.

Figure 7:
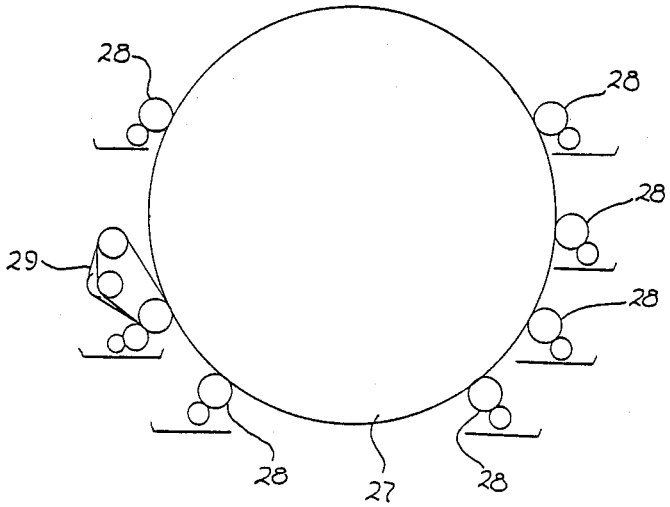
FIG. 7 is a diagrammatic end view of a flexographic central impression press incorporating one multiple belt printing station according to the invention.

FIG. 7 shows a central impression flexographic press having a central impression cylinder (27) and six conventional printing stations (28). These conventional printing stations may be utilized to print conventional impressions onto the surface of paper or other medium and can be used for multiple color or scratch silver applications in the conventional manner. One of the conventional stations is removed and substituted by a multiple belt station (29) of the type shown and described in FIGS. 1 and 2. In this way quasi random number tables can be printed from the single station (29)

while retaining the remaining conventional printing stations (28) for printing the remainder of the document of which the random number table forms a small part.

Figure 8:
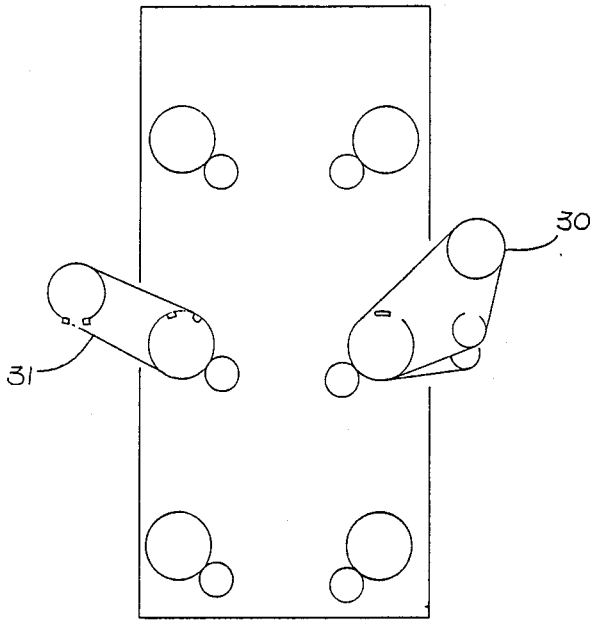
FIG. 8 is a diagrammatic end view of a six color stack press incorporating one single belt and one multi - belt printing station according to the invention.
Figure 9:
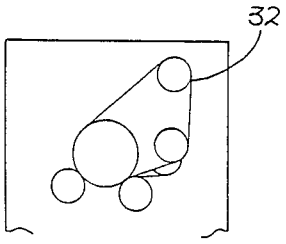
FIG. 9 is a diagrammatic end view of a narrow web single station press incorporating a multi - belt printing station according to the invention.

Various other combinations of multiple belt or single belt printing stations may be incorporated into various other types of printing press such as the six colored stack press shown in FIG. 8 having a multiple belt station (30) and a single belt station (31). FIG. 9 shows a narrow web press with a multi - belt printing station (32).

The printing apparatus according to the invention has a number of significant advantages over the prior art. For example when printing random number tables onto cylindrical objects such as cans it is possible to reliably print tables having very long repeat factors without any risk of errors leading to unbudgeted prize claims. Claims of this type can happen when jet printing which is commonly used for printing coding, date codes, etc. onto cans is used for promotions as the jet printing system is insufficiently reliable. Mechanical numbering is recognized by most security printers as being the most reliable as it is mechanical and functions continuously without stops while the machine is running. Conventional mechanical numbering however is very limited in the number of repeats that may be printed, but this problem is overcome by using multiple belt stations of the type described above. The invention allows quasi random number tables to be printed onto soft drink cans in high speed operations such as 1500 cans per minute in a mechanically synchronized continuous flow production.

Although the invention has been described thus far as a flexographic printing ink application system it could readily be adapted to off-set printing.

As an example of a six belt printing station, the belts are commonly provided of different lengths and typically with six different half inch gradients such as 61 half inch gradients on the first belt, 58 on the second, 53,47,41 and 49 gradients respectively on the other belts. All of these belt lengths are prime number lengths which give a large number of combinations, and in the example given above allow 1,433,520,900 numbers to be printed before the combination repeats. Although it is desirable for the endless belts to be prime number multiples of the base gradient, the belts can be non-prime multiples as long as they contain a multiplication of the prime number, e.g. $7\times5=35$.

Although the printing apparatus according to the invention has been described as being incorporated into larger printing press systems, it can also be used as an "outboard unit" separate from the normal printing press line or after a conventional printing press as a secondary printing process. This could be used in conjunction with a die cutting, gluing, perforating production line.

The variation of the invention shown in FIG. 4 has the advantage that four color capacity may be added at any one printing station. In this manner the invention adds four color capacity to one central impression press station at the expense of only one conventional station.

By adding the apparatus according to the invention to a gravure/flexo outboard unit on a gravure printing line, random game imprinting is achieved during normal gravure printing. Similarly the invention can be applied to a web off-set printing line to achieve random imprinting before, during or after the off-set printing process depending on drying requirements.

I claim:

1. A device for printing quasi random number tables comprising:

a printing plate cylinder, a plurality of continuous belts disposed about said printing plate cylinder, a common idle roller disposed within said belts, said idle roller spaced apart from said printing plate cylinder, a tension roller abutting said belts for providing tension to said belts;

each of said plurality of belts being of different length, each of said belts having gearing means disposed on one side thereof for engagement with said printing plate cylinder and maintaining registration between said belts and said printing plate cylinder, said belts having a plurality of flexographic printing plates disposed on another side thereof at a predetermined pitch;

each of said belts having a length which is a multiple of said predetermined pitch;

each of said printing plates having at least one number disposed thereon so that a plurality of numbers may be printed.

2. The device of claim 1 wherein said tension roller is disposed within said belts and away from said printing plate cylinder and idle roller.

3. The device of claim 1 wherein each of said belts has a length which is a prime number multiple of said predetermined pitch.

4. A method of printing quasi random numbers comprising the steps of;

disposing a first belt about a printing plate cylinder and an idle roller spaced apart from said printing plate cylinder, said first belt having flexographic printing plates disposed on one side thereof at a predetermined pitch;

disposing a second belt about said printing plate cylinder and said idle roller spaced apart from said printing plate cylinder, said second belt having flexographic printing plates disposed on one side thereof at said predetermined pitch, said second belt having a greater length than said first belt such that said belts produce a pattern that repeats after a predetermined time;

inking said belts;

bringing said belts into contact with a printing medium at said printing plate cylinder.

5. The method of claim 4 further including the step of disposing tension rollers adjacent said first and second belts.

6. The method of claim 4 wherein said belts have a length which is a prime multiple of said predetermined pitch.

* * * * *